US010280063B2

(12) United States Patent
Innes et al.

(10) Patent No.: US 10,280,063 B2
(45) Date of Patent: May 7, 2019

(54) PRESSURIZED TRANSFER DEVICE

(71) Applicant: Alexander G. Innes, Stockton, CA (US)

(72) Inventors: Alexander G. Innes, Stockton, CA (US); Christopher J. Wheeler, Stockton, CA (US)

(73) Assignee: Alexander G. Innes, Stockton, CA (US)

( * ) Notice: Subject to any disclaimer, the term of this patent is extended or adjusted under 35 U.S.C. 154(b) by 123 days.

(21) Appl. No.: 15/433,705

(22) Filed: Feb. 15, 2017

(65) Prior Publication Data

US 2017/0240414 A1 Aug. 24, 2017

Related U.S. Application Data

(60) Provisional application No. 62/297,338, filed on Feb. 19, 2016.

(51) Int. Cl.

| | |
|---|---|
| ***B67D 7/02*** | (2010.01) |
| ***B67D 7/36*** | (2010.01) |
| *B67D 7/84* | (2010.01) |

(52) U.S. Cl.

CPC ..... *B67D 7/0266* (2013.01); *B67D 7/0277* (2013.01); *B67D 7/36* (2013.01); *B67D 7/845* (2013.01)

(58) Field of Classification Search

CPC ..... B67D 7/0266; B67D 7/0277; B67D 7/36
See application file for complete search history.

(56) References Cited

U.S. PATENT DOCUMENTS

| | | | |
|---|---|---|---|
| 2,611,523 | A | 9/1952 | Aines |
| 2,669,941 | A | 2/1954 | Stafford |
| 2,682,886 | A | 7/1954 | Paxton |
| 2,985,192 | A | 5/1961 | Taylor et al. |
| 3,155,048 | A | 11/1964 | Mandelbaum et al. |
| 3,161,490 | A | 12/1964 | Dudek |
| 3,788,338 | A | 1/1974 | Burns |
| 3,932,065 | A | 1/1976 | Ginsberg et al. |
| 3,951,572 | A | 4/1976 | Ray, Jr. et al. |
| 4,106,671 | A | 8/1978 | Sharples |
| 4,250,933 | A | 2/1981 | Olson |
| 4,339,232 | A | 7/1982 | Campbell |
| 4,415,297 | A | 11/1983 | Boring |

(Continued)

FOREIGN PATENT DOCUMENTS

WO 2009018599 2/2009

OTHER PUBLICATIONS

Bullseye Pumps, Bullseye B200-SPDK Vacuum Loading Solids Pump, 2017, retrieved from http://www.bullseyepumps.com/products/bullseye-b200-spdk-vacuum-loading-solids-pump?variant=31478670788, 10 pages.

(Continued)

*Primary Examiner* — Kevin L Lee
(74) *Attorney, Agent, or Firm* — Brian S. Steinberger; Law Offices of Brian S. Steinberger, P.A.

(57) ABSTRACT

Devices, systems and methods of transferring liquids or mixtures/slurries of liquids and solids between vessels having challenging and difficult configurations and locations, and over long and short distances in a continuous or near continuous discharge for storage or transport using a combination of vacuum and pressurized fluids.

31 Claims, 12 Drawing Sheets

(56) References Cited

U.S. PATENT DOCUMENTS

| | | | | |
|---|---|---|---|---|
| 4,828,461 | A | 5/1989 | Laempe | |
| 4,945,955 | A | 8/1990 | Murphy | |
| 5,007,803 | A | 4/1991 | Divito | |
| 5,439,020 | A | 8/1995 | Lockhart | |
| 5,607,000 | A | 3/1997 | Cripe et al. | |
| 5,830,079 | A | 11/1998 | Hudson | |
| 6,264,434 | B1 | 7/2001 | Frank | |
| 6,280,408 | B1 | 8/2001 | Sipin | |
| 6,651,837 | B2 | 11/2003 | Stradinger et al. | |
| 6,938,691 | B2 | 9/2005 | Face | |
| 7,032,628 | B2 | 4/2006 | Guillemette et al. | |
| 7,100,631 | B2 | 9/2006 | Liu et al. | |
| 7,241,080 | B2 | 7/2007 | Klobucar et al. | |
| 7,708,504 | B2 | 5/2010 | Heckendorn et al. | |
| 7,998,251 | B2 | 8/2011 | Pondelick et al. | |
| 8,702,399 | B2 | 4/2014 | Krohn | |
| 8,727,671 | B2 | 5/2014 | Sundholm | |
| 8,763,855 | B1 * | 7/2014 | Harvey et al. ..... | B67D 7/0277 222/1 |
| 9,195,238 | B2 | 11/2015 | Roden et al. | |
| 2005/0025573 | A1 | 2/2005 | Waldman et al. | |
| 2010/0221125 | A1 | 9/2010 | Fulkerson et al. | |
| 2010/0264013 | A1 | 10/2010 | Burton | |
| 2014/0079573 | A1 | 3/2014 | Pabst | |
| 2015/0034176 | A1 | 2/2015 | Garcia Arguelles et al. | |
| 2015/0362000 | A1 | 12/2015 | Schmidt et al. | |

OTHER PUBLICATIONS

Sykes Pumps, General Purpose, GP50 Pump Performance, 2017, retrieved from http://www.sykespumps.com.sa/pumps/product-specs/gp_50_75.html, 2 pages.

Pentair Southern Cross, SX60 Portable Slurry Pump, 2017, retrieved from http://www.southerncross.pentair.com.au/product/market/pumps/vacuum-pumps/sx60-portable-slurry-pump/, 3 pages.

Wastecorp. Pumps, Super Duty, TVP-65 Series Vacuum Pumps, 2017, brochure, 1 page.

Innes, PCT Patent Application No. PCT/US17/18120 filed Feb. 16, 2017, Notification of Transmittal of the International Search Report and the Written Opinion of the International Searching Authority, or the Declaration dated May 10, 2017, 14 pages.

Innes, et al., PCT Patent Appl. No. PCT/US2017/018120 filed Feb. 16, 2017, Notification Concerning Transmittal of International Preliminary Report on Patentability, 12 pages.

* cited by examiner

PRESSURIZED TRANSFER DEVICE

This application claims the benefit of priority to U.S. Provisional Patent Application Ser. No. 62/297,338 filed Feb. 19, 2016, which is incorporated by reference in its' entirety.

FIELD OF INVENTION

This invention relates to transferring liquids or mixtures/slurries of liquids and solids, and in particular to devices, systems and methods of transferring liquids or mixtures/slurries of liquids and solids between vessels having challenging and difficult configurations and locations, and over long and short distances in a continuous or near continuous suction or discharge for storage, transport, or processing.

BACKGROUND AND PRIOR ART

The transferring of liquid material or mixtures/slurries of liquid and solid material from one vessel to another has typically been done in one of two ways. The material can be sucked from the source vessel into a discharge vessel via vacuum, or pushed from the source vessel to a discharge vessel under positive pressure with a pump.

Due to the limited pressure differential available with vacuum driven systems, material cannot be transferred over large elevation differences or long lengths of hose.

Furthermore, vacuum systems tend to be large, heavy, vehicle or trailer transported systems that cannot reach every source vessel.

When removing material from a source vessel that is not capable of being pressurized the pump must be placed near, into, or under the source vessel to collect material from the source vessel. This will often place significant limitations on the system.

Additionally, the elevation differences and hose lengths utilized on the inlet side of pump systems are even more limited than vacuum systems.

Pumps also have trouble pumping mixtures or slurries containing large or fibrous solid materials, because they have small openings that tend to plug or foul and/or, moving, reciprocating and/or rotating components that become jammed or entangled.

Using pumps larger than the application would normally require, provides larger opening sizes to help prevent fouling/plugging. This technique often has limited benefit because of physical or size limitations and oversizing these pumps also results in a loss of efficiency.

The configuration of the source vessel may also pose a challenge. Limited access for installing a pump on the interior or underneath the vessel often makes it difficult to draw the material into the pump so that it can be pumped away.

Thus, the need exists for solutions to the above problems with the prior art.

SUMMARY OF THE INVENTION

A primary objective of the present invention is to provide devices, systems, and methods to transfer material (liquids and/or mixtures/slurries of liquids and solids) from a source vessel (particularly one with a difficult or challenging configuration or location) to a discharge vessel for storage, transport, or processing.

A secondary objective of the present invention is to provide devices, systems, and methods to transfer material (liquids and/or mixtures and/or slurries of liquids and solids) from a source vessel over long distances between the source vessel and the discharge vessel with large and/or fibrous solids without fouling and plugging.

A third objective of the present invention is to provide devices, systems, and methods to transfer materials (liquids and/or mixtures and/or slurries of liquids and solids) with a continuous or near continuous suction and/or a continuous or near continuous discharge between a source vessel and a discharge vessel. This is beneficial because often the material being transferred will negatively change consistency or properties when the discharge is stopped or slowed. Increases in viscosity, or settling of solid particles in the discharge hoses are common problems when the velocity of the discharge flow drops.

The novel device can include 2 or more vessels, but could be a single vessel. With multiple vessels, for the majority of each cycle at least one vessel is filling under vacuum and at least one vessel is discharging under pressure.

The vessels can be vacuum driven by an internal or external vacuum system which charges one of the vessels and draws material into the vessel. Pressurized fluid, such as but not limited to compressed air, and the like, can be generated from an internal or external compressor/pump system or exhaust from the vacuum system. The pressurized fluid can be used to discharge the other vessel(s) by displacing the material with fluid.

The devices, systems and methods can operate in a cyclic manner. For two or more vessels the first vessel fills while the other(s) discharge(s), then the vessels switch operation, another vessel discharges as the first is filling. Each vessel is filled and discharged in an alternating or staggered manner and the cycle repeats.

The vessels can be sized to provide longer cycles with larger volumes, or shorter cycles with smaller volumes. Smaller vessels provide for a smaller, lighter, mobile device that can be positioned in close proximity to source vessels in tight spaces traditional systems can't reach.

The devices, systems and methods can be mobile, including a type of transportation, that can include but is not limited to being via integrated single or double wheelbarrow wheel(s) and handles, multi-wheel configurations, or vehicle, trailer, or other transport technique.

Additionally, adjustable legs and/or stabilizers appropriate for setting and operating the equipment can also be included.

Further objects and advantages of this invention will be apparent from the following detailed description of the presently preferred embodiments which are illustrated schematically in the accompanying drawings.

45, 46, optional pinch valve cross-over valves 41, 42 to improve efficiency, and vacuum exhaust 33 to improve response.

Figure 5:
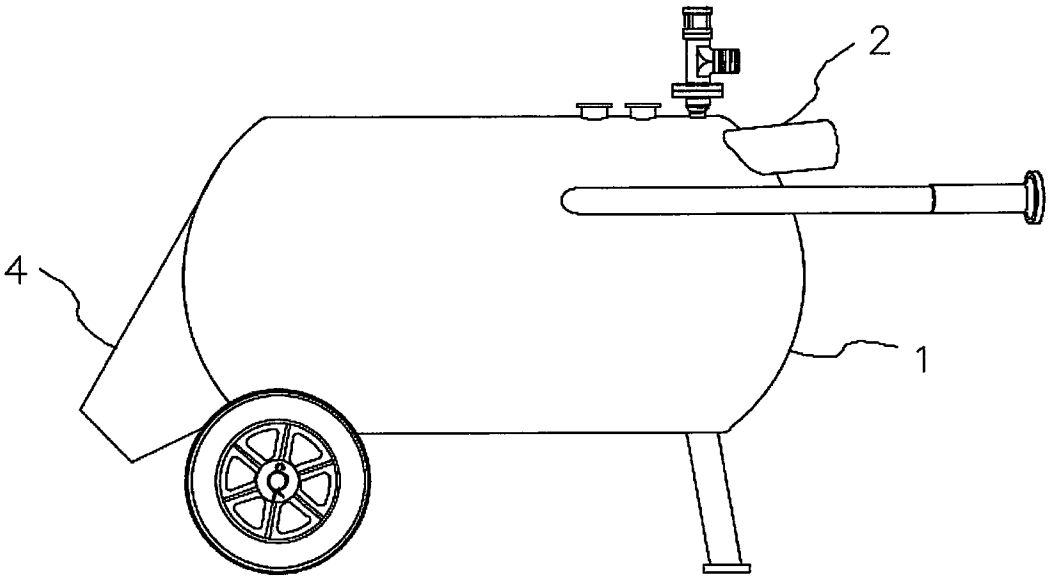

FIG. 5 shows an external view of a horizontal vessel embodiment.

Figure 6:
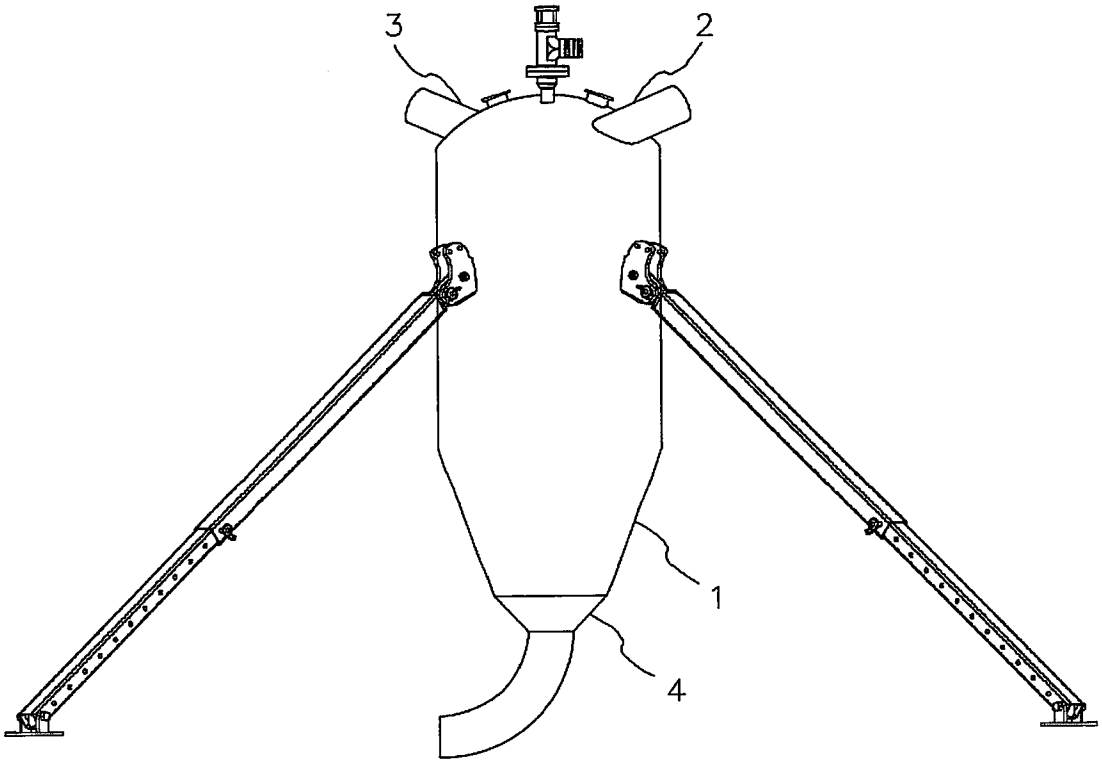

FIG. 6 shows an external view of a vertical vessel embodiment.

Figure 7:
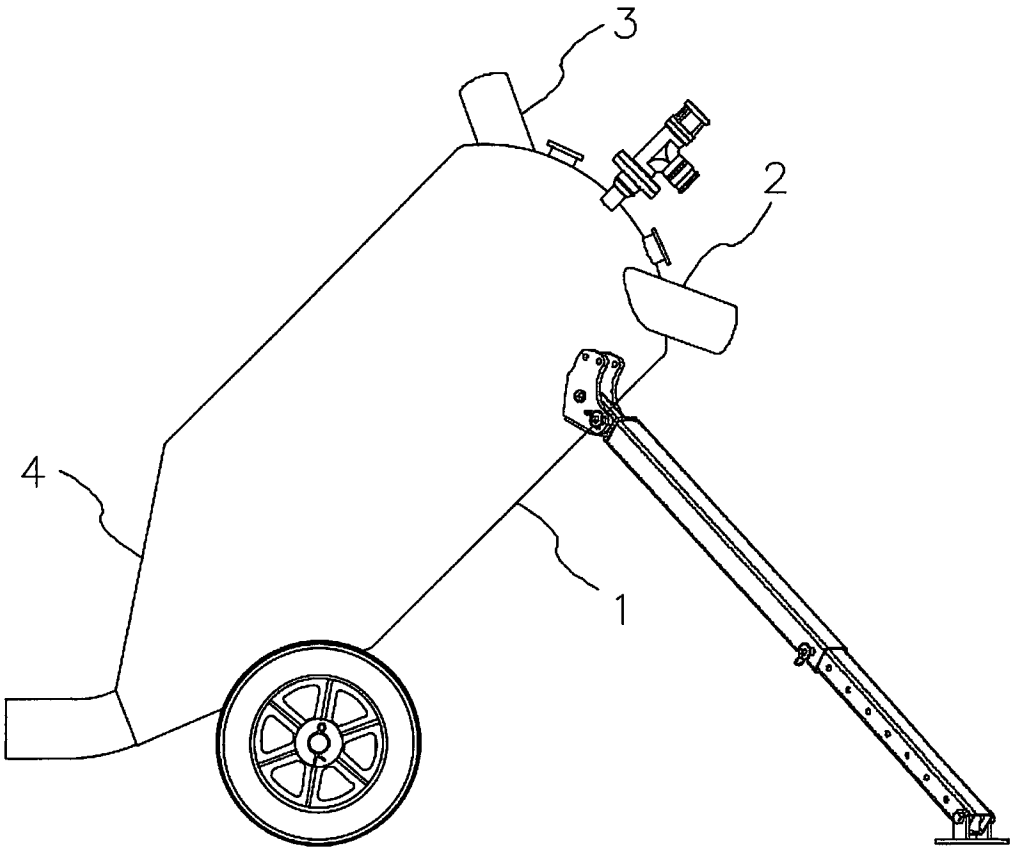

FIG. 7 shows an external view of an angled vessel embodiment.

Figure 8:
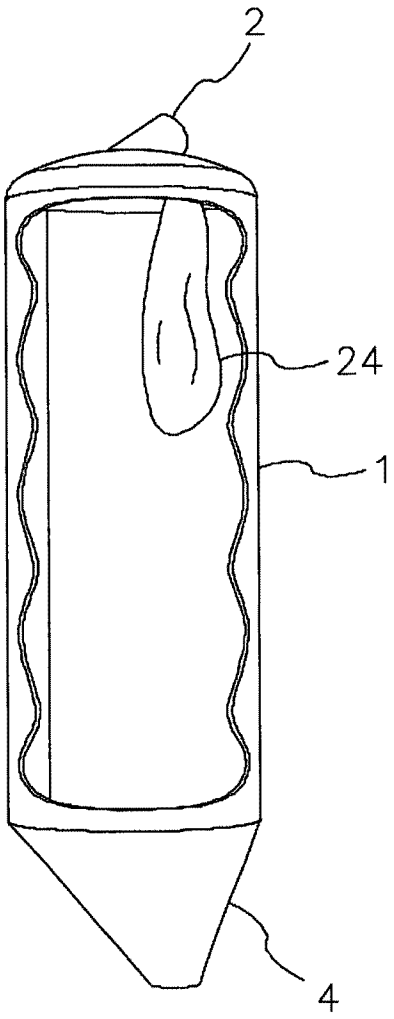

FIG. 8 shows an embodiment with a partial cut-away view of an internal bladder separating the compressed fluid from the material in the vessel, with the bladder deflated.

Figure 9:
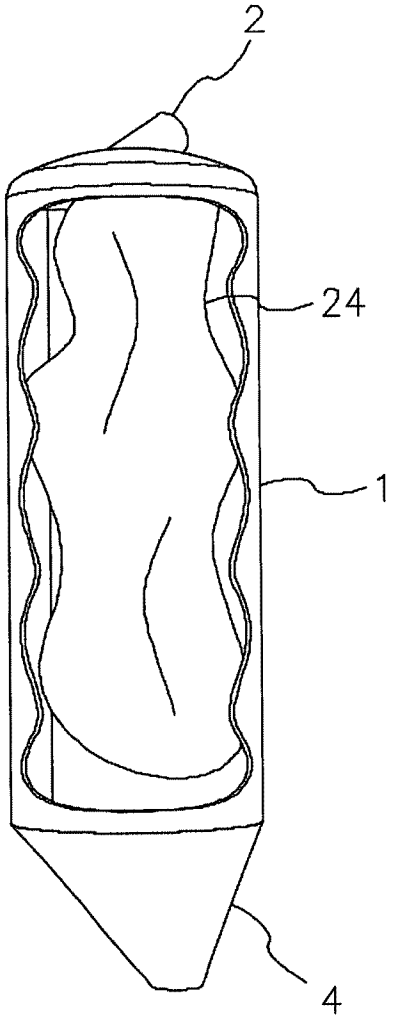

FIG. 9 shows an embodiment with a partial cut-away view of an internal bladder separating the compressed fluid from the material in the vessel, with the bladder inflated, displacing material in the vessel.

Figure 10:
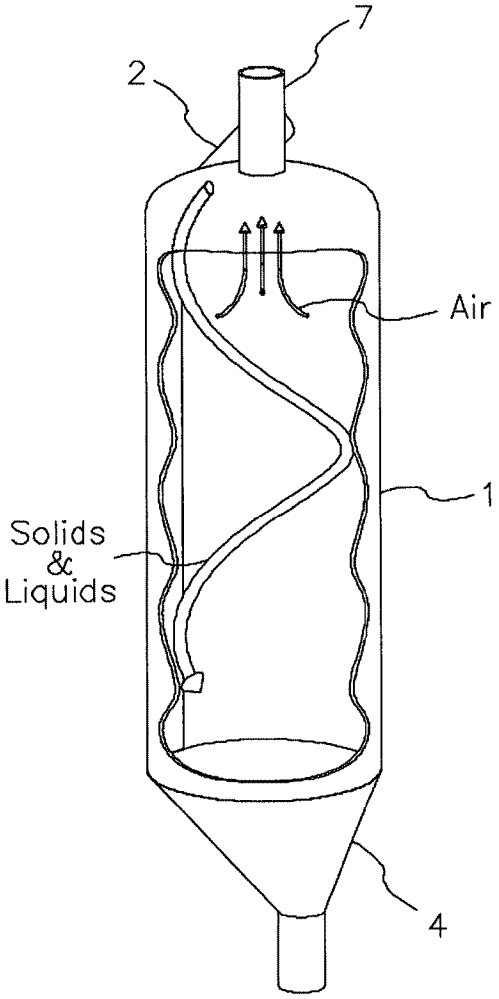

FIG. 10 shows an embodiment with a partial cut-away view illustrating the flow of liquid, solids, and air into the vessel from the tangential inlet.

Figure 11:
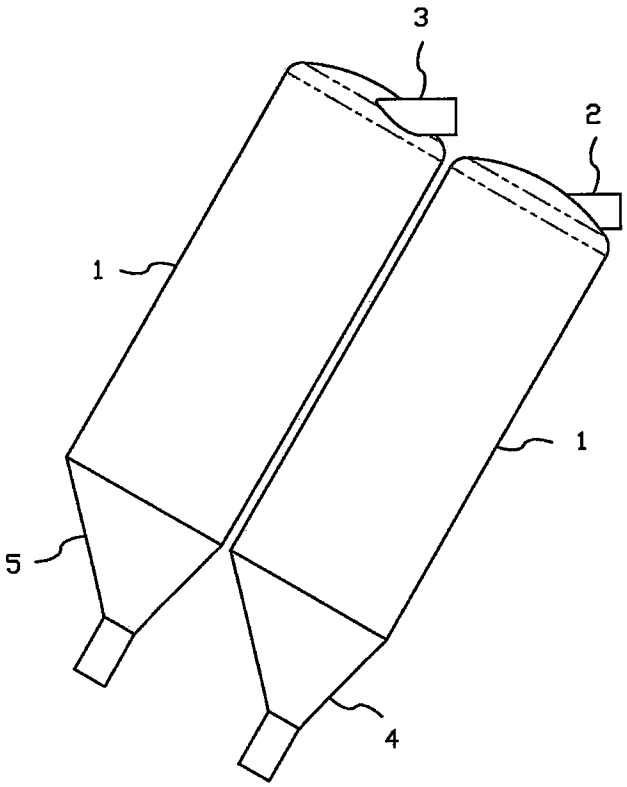

FIG. 11 shows an embodiment with two separate vessels positioned one on top or one in front of the other that can be temporarily or permanently attached to each other.

Figure 12:
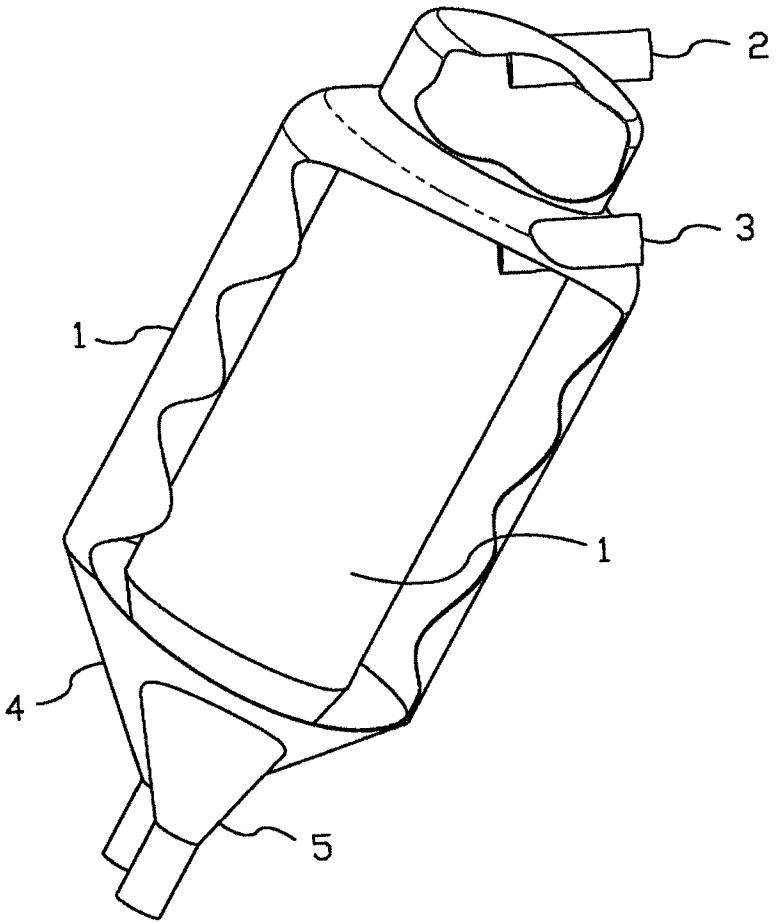

FIG. 12 shows an embodiment with a partial cut-away view illustrating two concentric vessels with one encircled by the other.

Figure 13:
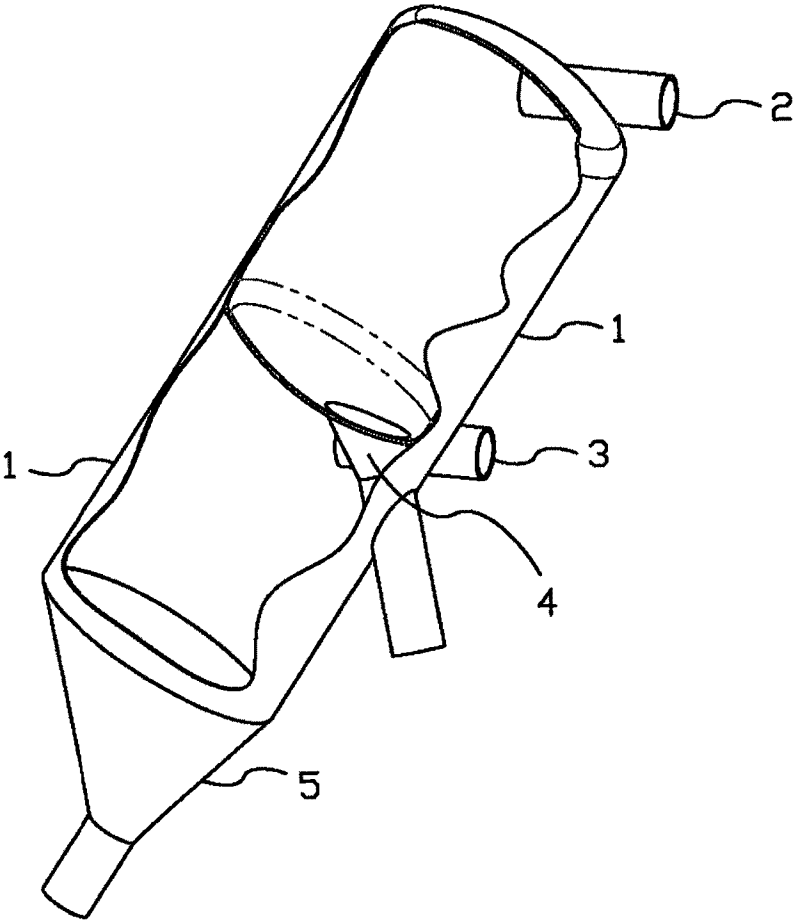

FIG. 13 shows an embodiment with a partial cut-away view illustrating two concentric vessels with one in line and above the other.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

A list of components will now be described.

1 vessel(s)

2, 3 tangential inlet(s), such as a length of pipe, similar to what is found on a hydro-cyclone or cyclonic separator

4, 5 outlet(s)

6 divider/wall

7, 8 vacuum outlet(s), such as a length of pipe or a pipe coupling

9, 10 pressurized fluid/compressed air inlet(s), such as a length of pipe or a pipe coupling

11, 12 cross-over port(s), such a length of pipe or a pipe coupling

13 suction pipe or hose

14 inlet Y

15, 16, 17, 18 pinch valves, such as a manual, mechanical, pneumatic, or hydraulic gate type pinch valves, or pneumatic or hydraulic sleeve type pinch valves

19, 20 vacuum valve(s)/outlet(s), such as a length of pipe or a pipe coupling with a manually, pneumatically, hydraulically, or electrically operated gate, ball, globe, or pinch valve

21, 22 valve(s) to control charging, such as a direct operated solenoid valve

23 cross-over valve, such as a manually, pneumatically or hydraulically operated gate, ball or globe valve

24 bladder, such as an expansion tank bladder or diaphragm

25 discharge Y

26 discharge conduit (such as pipe or hose)

27, 28 relief device(s), such as a pressure relief valve or burst disk

29, 30 pressure sensor(s), such as a pressure transducer or gauge

31, 32 continuous level sensor(s), such as a continuous float, laser or ultrasonic level transducer or discrete level sensor(s) such as capacitive, float, or tuning fork type sensors

33 vacuum supply system, such as a rotary vein, liquid ring, or Roots blower vacuum pump, educator, or ejector

34 pressurized fluid/compressed air supply system, such as a reciprocating, centrifugal, or screw type compressor or pump

35 source vessel

36 discharge vessel

37 defouling valve, such as a direct operated solenoid valve

38 suction end

39 vacuum supply hose

40 pressure supply hose

41, 42 pinch valve cross-over valves, such as a direct or pilot operated solenoid valve, spool valve, or diaphragm valve

43, 44, 45, 46 pneumatic control valves, such as a direct or pilot operated solenoid valve, spool valve, or diaphragm valve Liquids such as but not limited to water, oil, petroleum or petroleum byproducts, soap, alcohol, chemical products and/or bodily fluids.

Solids, such as but not limited to sand, dirt, hair, rope, cloth, textiles, metal, ceramic, glass, or plastic particulate or debris.

Mixtures, such as but not limited to blood, beverages, coolants, adhesives, shampoo or mouthwash.

Slurries, such as but not limited to sanitary (human or animal), industrial, chemical, or mining waste streams, food products, or pulp composed of solid fibers or particles in a liquid mixture.

Liquefied material being solids mixed with liquids so as to create a fluid, such as but not limited to clay slurry or mud or combinations thereof, and the like.

The distance between the source and discharge vessels could range from approximately a few feet to approximately 1,000 feet or more, depending on the available pressure and hose diameters, lengths and pressure capacities.

Figure 1:
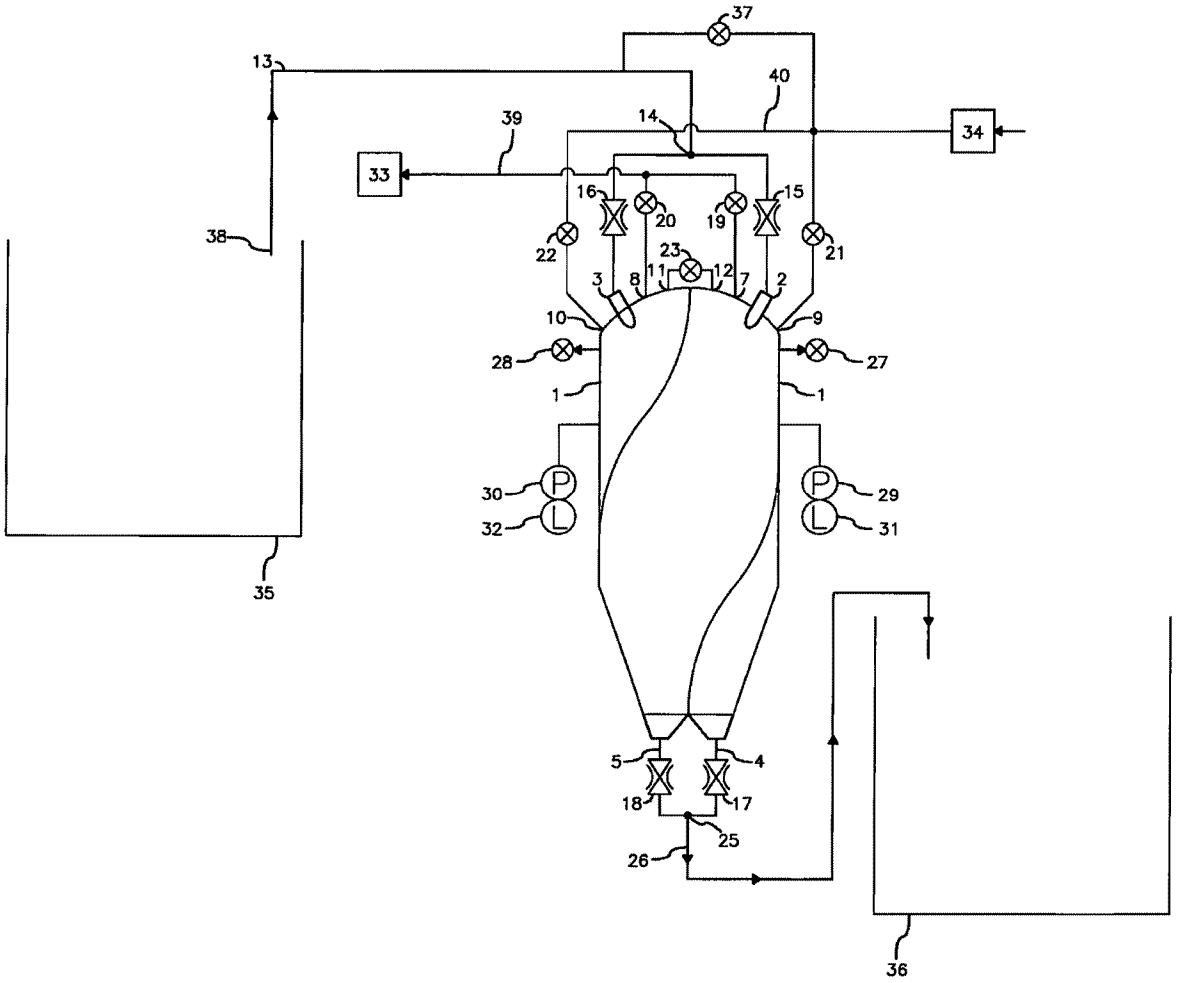
FIG. 1 shows a schematic diagram of a two vessel embodiment with the vessels integrated into a single structure, including the process valves and primary connections.

FIG. 1 shows a schematic diagram of a two vessel embodiment with the vessels integrated into a single structure, including the process valves and primary connections.

Figure 2:
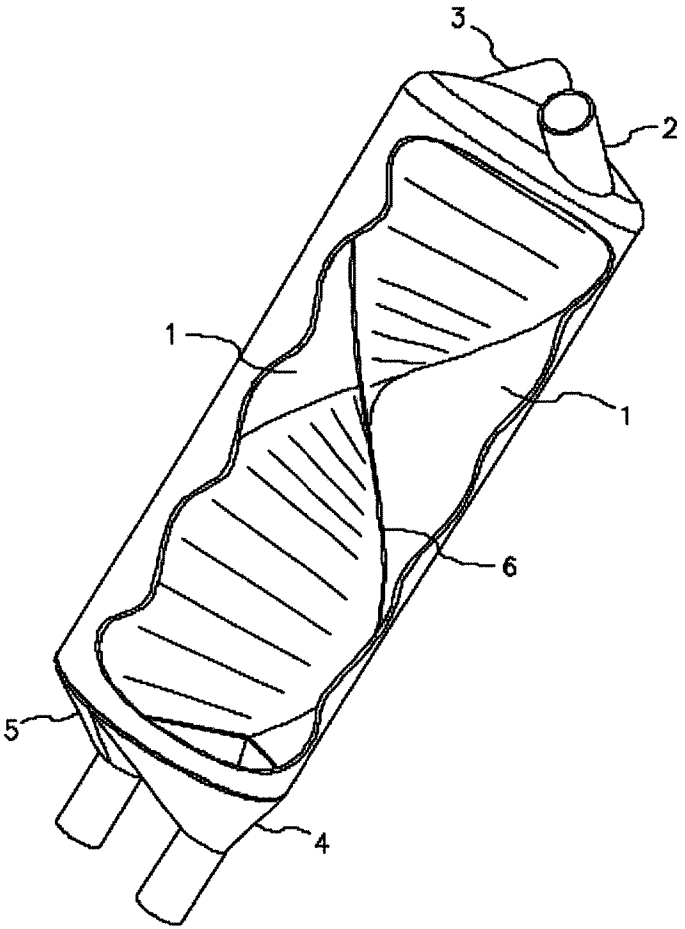
FIG. 2 shows a two vessel embodiment with a partial cut-away view with the vessels integrated into a single structure, with a helical/twisted divider between the two vessels.

FIG. 2 shows a two vessel embodiment with a partial cut-away view with the vessels integrated into a single structure, with the helical/twisted divider between the two vessels.

Figure 3:
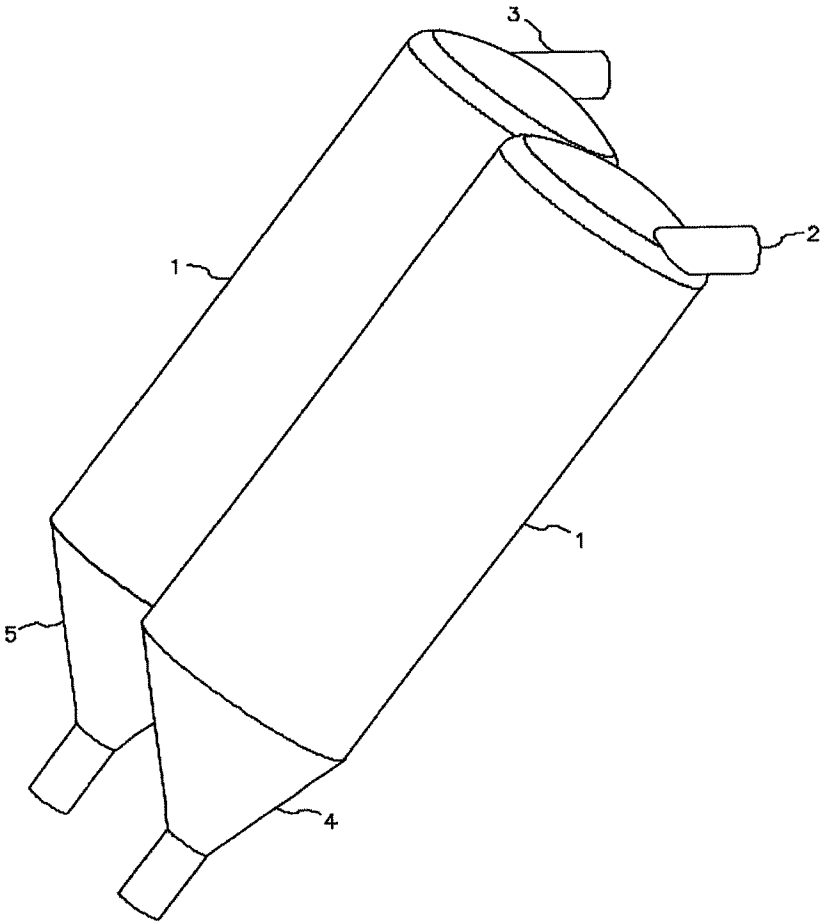
FIG. 3 shows an external view of a two vessel embodiment with two independent side-by-side vessels that can be temporarily or permanently attached to each other.

FIG. 3 shows an external view of a two vessel embodiment with two independent side-by-side vessels that can be temporarily or permanently attached to each other.

Figure 4:
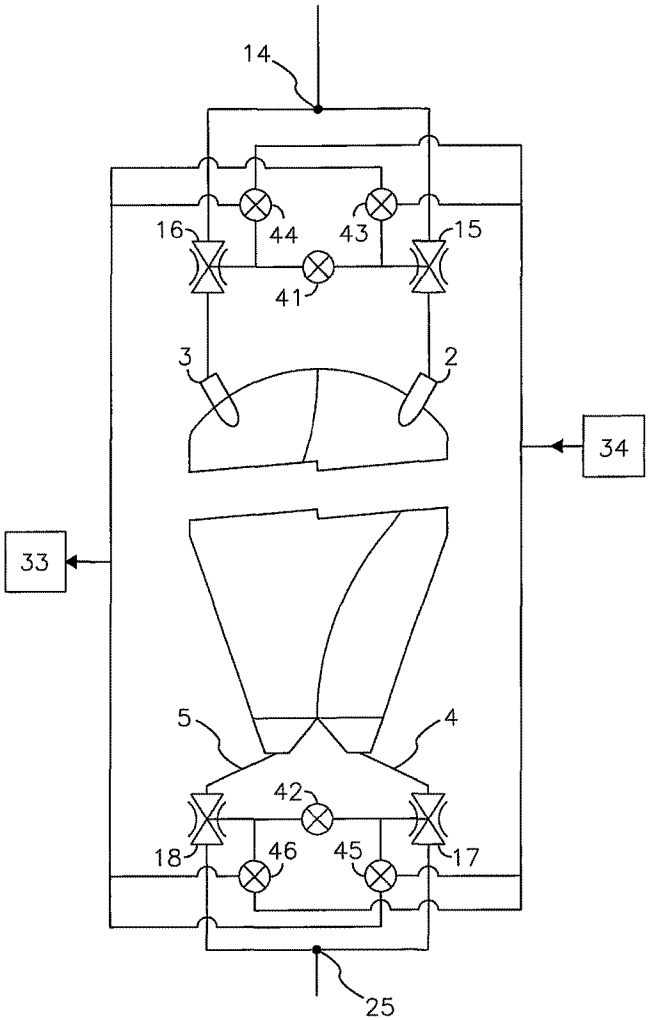
FIG. 4 shows a schematic diagram illustrating the connection of pneumatically operated pinch valves 15, 16, 17, 18, pneumatic source 34, pneumatic control valves 43, 44.

FIG. 4 shows a schematic diagram illustrating the connection of pneumatically operated pinch valves 15, 16, 17, & 18, pneumatic source 34, pneumatic control valves 43, 44, 45, & 46, optional pinch valve cross-over valves 41 & 42 to improve efficiency, and vacuum exhaust 33 to improve response.

FIG. 5 shows an external view of a horizontal vessel embodiment.

FIG. 6 shows an external view of a vertical vessel embodiment.

FIG. 7 shows an external view of an angled vessel embodiment.

FIG. 8 shows an embodiment with a partial cut-away view of an internal bladder separating the compressed fluid from the material in the vessel, with the bladder deflated.

FIG. 9 shows an embodiment with a partial cut-away view of an internal bladder separating the compressed fluid from the material in the vessel, with the bladder inflated, displacing material in the vessel.

FIG. 10 shows an embodiment with a partial cut-away view illustrating the flow of liquid, solids, and air into the vessel from the tangential inlet.

FIG. 11 shows an embodiment with two separate vessels positioned one on top or one in front of the other that can be temporarily or permanently attached to each other.

FIG. 12 shows an embodiment with a partial cut-away view illustrating two concentric vessels with one encircled by the other.

FIG. 13 shows an embodiment with a partial cut-away view illustrating two concentric vessels with one in line and above the other.

Devices can be comprised of one, two, three or more vessels 1, preferably cylindrical or nearly cylindrical in shape, made from metal, plastic, fiber reinforced plastic, or other material or combination of materials.

Referring to FIGS. 1-13, the embodiments can include one, two, three or more vessels 1, that can be preferably cylindrical or nearly cylindrical in shape. The vessels 1 can be made from metal, plastic, fiber reinforced plastic, or other material, and the like.

Each vessel can range in size from less than approximately five gallons to over approximately one hundred gallons, depending on the application and available power and/or transport method.

Each vessel 1 can have a tangential inlet 2, 3 toward the top of the vessel. Each vessel 1, can have an outlet 4, 5, that can include a cone or nearly cone shape. The outlets 4, 5 can preferably be located towards the bottom to take advantage of gravity in directing fluid toward the outlet at the lowest point.

Each vessel 1 can be completely independent, temporarily or permanently attached to each other, as shown in FIG. 3 or FIG. 11, or integrated into a single structure, as shown in FIG. 2, FIG. 12, or FIG. 13.

As shown in FIG. 2, for multiple vessels integrated into a single structure (cylindrical or otherwise) the divider/wall 6 can be between each vessel. The divider/wall 6 can follow a helical/twisted path (approximately following the path of the material entering from the tangential inlet) in order to provide a longer uninterrupted path for the material to follow, as well as to provide additional strength/stiffening against the pressure differential between vessels sharing the common divider/wall 6.

The vessel(s) 1, can each have a vacuum outlet 7, 8, preferably at or near (adjacent) the top of each vessel 1.

The vessel(s) 1 can each have a pressurized fluid/compressed air inlet 9, 10, preferably at or near the top of each vessel 1.

The vessel(s) 1 can each be optionally fitted with an additional cross-over port(s) 11, 12, preferably near (adjacent) the top of each vessel 1, for the purposes of equalizing the pressure between two or more vessels 1.

The vessel(s) 1 can each be arranged horizontally, as shown in FIG. 5, vertically as shown in FIG. 6, or at an angle to the ground as shown in FIG. 7, in order to improve flow of material through the vessel and/or balance a more easily mobile design, with a lower center of gravity for transport with a smaller footprint and/or compact, simpler design.

A common suction pipe or hose 13 (as shown in FIG. 1) can be used to draw liquids and/or solids into the system.

Referring to FIG. 1, a de-fouling valve 37, can be remotely controlled or manually operated, and can optionally be included between the pressurized fluid or compressed air system 34 and the suction end 38 of the common suction pipe or hose 13 for the purposes of positively pressurizing the common suction pipe or hose 13, or a portion thereof, so as to push any material that can block, foul or plug the common suction pipe or hose 13 out of the suction end 38.

The suction end 38 of the common suction pipe or hose 13 can include an optional suction classifier fitting with an opening smaller than the smallest passage in the process flow so that any objects that pass through the classifier fitting can pass through the entire system.

The common suction pipe or hose 13 can be connected to an inlet Y 14 to direct flow from the common suction pipe or hose 13 to one of the vessels 1.

Pinch valves that can comprise or consist of an elastic or semi-elastic cylindrical, nearly cylindrical or tubular member are used to control process flow. This elastic member can be pinched closed—either mechanically, hydraulically, or pneumatically—in order to effectively block the flow of material through the valve. When relaxed/open the cylindrical member has an inside dimension nearly that of other piping in the general vicinity so as not to create undue restriction, fouling or plugging. The cylindrical member is fixed at the openings and stretches during operation so as not to expose openings or passages for material to foul, damage, or wear.

Referring to FIG. 1, a pinch valve at the inlet of each vessel 15, 16 can control which vessel 1, the inlet flow is directed to. A pinch valve at the outlet of each vessel 17, 18 can control which vessel the discharge flow is directed from.

A vacuum valve 19, 20 at the vacuum outlet of each vessel controls which vessel is charged with vacuum.

A valve(s) to control charging 21, 22 on the pressurized fluid/compressed air inlet of each vessel controls which vessel is charged with pressurized fluid/compressed air.

Referring to FIG. 1, an optional cross-over valve 23 can be fitted between the cross-over ports of each vessel to control the equalization of pressure between vessels.

Each valve can be operated by electrical, air, fluid, mechanical or other means.

Referring to FIG. 4, an optional pinch valve cross-over valve 41, 42 can be fitted between the operating ports of pneumatic or hydraulically operated pinch valves to control the equalization of pressure between pinch valves.

A discharge Y 25 can be used to connect all of the discharge valves from each vessel to a common discharge pipe or hose 26.

Referring to FIG. 1, inlet and outlet Y's 14, 25 and all process flow piping and hose can utilize long radius sweeps (instead of tight elbows) to prevent fouling or clogging.

Referring to FIG. 1, a discharge pipe or hose 26 can be used to direct the output of the machine to a separate storage and/or transportation vessel or container.

Referring to FIG. 1, a vacuum system 33 can optionally be connected to the exhaust of compressed air valves (shown in FIG. 4), actuators and/or pinch valves in order to improve responsiveness.

Referring to FIG. 1, the vessel(s) 1 can optionally have a relief device 27, 28 to prevent over pressurization for safety purposes.

Each vessel 1, can optionally be fitted with a pressure sensor 29, 30 to monitor the pressure in the vessel.

The vessel(s) 1 can optionally be fitted with one or more discrete or continuous level sensors (31 & 32) in order to monitor the level of material being transferred to and from each vessel (including float, tuning fork, capacitive, and the like, style discrete sensors, or laser, capacitive, resistive, pressure, and the like style continuous sensors).

Programmable, electrical, pneumatic, hydraulic or mechanical control systems, or combination thereof, can be used to monitor the various sensors and indicators (inputs) on the system and control the various actuators and functions (outputs).

Operator interfaces can be included and mounted at a convenient location, on or near the body of the vessels, on or near the common suction pipe or hose, or at a fixed, movable, or removable location elsewhere on the device.

Referring to FIGS. 1 and 4, a vacuum can be provided by an external source 33, can be connected via a hose 39, or by an integral or attached vacuum system driven by an engine, electric motor, or fluid educator/ejector.

Referring to FIGS. 1 and 4, pressurized fluid/compressed air can be provided by an external source 34 connected via a hose 40, by the exhaust of the vacuum system, or by an integral or attached pump/compressor driven by an engine or electric motor.

Additionally, an optional bladder 24 can be used in the vessel to separate the pressurized fluid/compressed air from the material being transferred into or out of the vessel as shown in FIGS. 8 and 9.

The operation will now be described in relation to FIGS. 1 and 4. Opening the valve at the vacuum outlet 19 or 20 of one vessel can evacuate that vessel (all other valves connected to that vessel being closed).

Opening the pinch valve at the inlet of an evacuated vessel 15, 16 will cause material (solids and liquids entrained in air) to be sucked from the source vessel 35, through the common suction pipe or hose 13 into that vessel.

The material can enter one of the vessels through the tangential inlet 2, 3 and can be directed by the vessel walls in a circular or helical path, as shown in FIG. 10, causing the heavier particles and more dense liquids and solids to be forced to the outside of the path via centrifugal action, separating them from the air flow.

The larger volume of the vessel (compared to the common suction pipe or hose) causes the flow velocities to drop. The reduced flow velocity and centrifugal action allows the heavier solids and liquids to separate from the air flow and drop to the bottom of the tank, while the air is drawn into the vacuum outlet by the vacuum flow.

As the vessel fills with material, sensors 31, 32 can measure the level of material in the vessel and close the valve at the vacuum outlet 19, 20 and the pinch valve at the vessel inlet 15, 16 in a predetermined sequence based on the level of material in the tank, to fill or nearly fill the vessel, without causing it to overfill.

Opening the valve at the pressurized fluid/compressed air inlet 21, 22 of one vessel will charge that vessel with pressurized fluid/compressed air (all other valves connected to that vessel being closed).

Opening the pinch valve at the outlet of a vessel charged with pressurized fluid/compressed air 17, 18 can cause material in the vessel to be pushed through the outlet 4, 5, through the discharge Y 25, and into the discharge vessel 36, via the discharge pipe or hose 26, at some distance from the device.

As the vessel empties the material, sensors 31, 32 can measure the level of material in the vessel and close the valve at the pressurized fluid/compressed air inlet 21, 22 and the pinch valve at the vessel outlet 17, 18 in a predetermined sequence based on the level of material in the tank, to empty or nearly empty the vessel, while minimizing interruption in discharge flow and minimizing unnecessarily discharging pressurized fluid/compressed air and/or minimizing interruptions in the suction flow.

Once a vessel has been filled and emptied the fill and empty cycle can be repeated in a continuous or semi-continuous manner. Using two or more vessels a nearly constant flow rate and little to no stoppage in the discharge and/or suction flow when switching between discharge vessels can be obtained. With three or more vessels the start of discharge from one vessel can be overlapped with the completion of discharge from another vessel, so the interruption in discharge flow is further minimized while switching vessels.

When multiple vessels are used, the operation of each vessel can be alternated or staggered, with one or more vessels filling while one or more vessels are emptying, in order to obtain a more continuous discharge flow.

When multiple vessels are available the option exists to operate the device in a mode with a single vessel, allowing the other vessels to sit idle, depending on the circumstances and/or requirements of the application.

With a single vessel embodiment and/or utilizing a single vessel of a multi-vessel embodiment a number of the components, features and options listed or described will not be applicable, used, or needed and can be omitted from the device, or included to allow for additional options and/or expansion at a later time.

As an alternative to level monitoring, adjustable or non-adjustable fill timers can be used to control the filling and discharging of the vessels. This approach can better accommodate transfer of materials that the level sensors have difficulty sensing while sacrificing efficiency as the timer intervals must be conservatively selected in order to prevent overfilling.

Timing of valve operation can be a function of the control system, and can be configured to utilize as much of the stored pressure/vacuum in each vessel as possible, improving system efficiency, particularly when using level sensors well suited for the particular media being transferred.

Once the level sensors, or fill timers, indicate that one of the vessels is nearly full or nearly empty one or more time delays are started. Each time delay is configured to initiate the next step in the operating procedure after the delay, such as closing the vacuum supply valve, closing the valve(s) that controls charging the tanks, closing the inlet or outlet pinch valves. The time delays can be started based on a specific sensor signal, valve operation, or the expiration of a previous time delay.

By adjusting the length of the time delays the function of the unit can be adjusted, for instance waiting longer to close the inlet pinch valve will result in a tank that is filled with a greater volume of material being transferred and less volume of vacuum. Similarly, waiting longer to close the outlet pinch valve will result in a tank that is filled with a greater volume of compressed air and less volume of material being transferred. Filling and discharging the vessels to a greater degree will increase the amount of material transferred with each cycle, with a tendency to increase the efficiency of the system.

At a certain point increasing the time delay on a specific function may not increase the overall amount of material transferred significantly, but will still increase the cycle time of the system. When this occurs, the tendency will be for the efficiency of the system to decrease. The time delays can be adjusted to obtain the maximum overall efficiency across this range of variables, or could be biased to prioritize maximum flow rate or total system efficiency over the other.

Additionally, the more each vessel is filled or discharged increases the risk that the vessel may be over-filled or over-discharged, drawing material being transferred into the vacuum supply hose or pushing excessive air into the discharge pipe or hose. The timing will have to be balanced against this, depending on what is being transferred and the frequency of these occurring.

Furthermore, the timing of the valve closures can create two basic cycle configurations. One configuration prioritizes continuous or near continuous discharge flow, while interrupting the suction flow as required while switching between vessels. This reduces the discharge of compressed air and helps prevent problems that can occur in the discharge pipe or hose when flow is stopped, such as solids settling and increases in viscosity. The sacrifice of interrupting the suction flow will often reduce operating efficiency as material in the common suction pipe or hose can drain back into the suction vessel during this interruption.

The other basic configuration prioritizes continuous or near continuous suction flow at the expense of interrupting the discharge flow as required when switching between vessels. Prioritizing the suction flow increases operating efficiency as little or no material in the common suction pipe or hose can drain into the suction vessel while switching vessels. The disadvantage is the possible introduction of compressed air to the discharge pipe or hose as well as potential problems with settling and increases in viscosity while transferring some materials.

The pressurized or evacuated volumes in each vessel at the end of each half cycle store a significant amount of energy. The timing of the valves can be adjusted to allow the pressure or vacuum level in each vessel to decay at the end of each cycle, utilizing more of the stored energy. For instance, if during the suction portion of the cycle the vacuum valve is closed some time before the inlet pinch valve is closed this would allow the evacuated space in the vessel to fill with material brought in through the inlet, while the vacuum level decays. In this manner more work can be done with the stored vacuum, as opposed to venting the vacuum to atmosphere, or filling with air from the pressure system. Doing this will further increase the energy efficiency of the system, while slowing the overall transfer rate because for part of the cycle material is being transferred at a reduced vacuum level.

Similarly, if during the discharge portion of the cycle the valve controlling charging is closed some time before closing the discharge valve the stored compressed air in the vessel can be used to push material out the discharge, while the pressure level decays, as opposed to venting the pressure to atmosphere, or evacuating the volume with the vacuum system. The tradeoff of this is that each cycle may take longer to complete (as less pressure is available to motivate material, as the pressure decays), with a corresponding tendency toward decreased efficiency. The time delays can be adjusted to obtain the maximum overall efficiency across this range of variables.

Referring to FIG. 1, an optional cross-over valve 23 can be fitted between the cross-over ports of each vessel 11 and 12.

The cross-over valve 23 can be opened after one vessel has been filled or nearly filled and the other has been emptied or nearly emptied to allow the pressure in both vessels to equalize.

Once the pressure in the vessels have equalized or nearly equalized, the cross-over valve 23 is closed before the cycle continues with opening the vacuum valve on one vessel to charge that vessel with vacuum and the valve to control charging on the other vessel to charge that vessel with pressurized air.

At the end of each half cycle at least a portion of one vessel is charged with pressurized air and at least a portion of one vessel is charged with vacuum. At the start of the next half cycle the pressurized vessel must be evacuated and the evacuated vessel must be pressurized.

It takes energy to pressurize and evacuate these vessels, and a portion of the power required to operate the system is expended during this portion of the cycle. Equalizing the pressure between two or more vessels, by opening the cross-over valve momentarily, before charging with pressure or vacuum, reduces the power required to pressurize and evacuate these vessels, thereby reducing the overall power consumption and operating cost of the system.

While the cross-over is open the two vessels equalize in pressure to a level in between the level the vessels started at. The pressure in a pressurized vessel that is going to be evacuated at the start of the next cycle is lowered, and the pressure in an evacuated vessel that is going to be pressurized at the start of the next cycle is raised, without any additional power expended by the system.

An optional pinch valve cross-over valve(s) 41, 42 can be fitted between the operating or control ports of pinch valves or groups of pinch valves.

The pinch valve cross-over valve(s) 41, 42 can be opened when specific pinch valves or groups of pinch valves are to be operated in opposite functions (i.e. one closing, while another opens) to equalize the pressure in the pinch valves.

After the pressure in the pinch valves have equalized or nearly equalized the pinch valve cross-over valve is closed before the pinch valves can be fully actuated and the cycle continued.

Equalizing the pressure between two or more pinch valves before charging and fully actuating them allows some of the energy stored in the residual pressure or vacuum from one pinch valve to be used to pre-charge the other pinch valve(s), either by reducing the pressure in a pressurized pinch valve that is going to be evacuated, or by increasing the pressure in a pinch valve that is evacuated and is going to be pressurized—thereby reducing the overall power consumption of the system. This operation functions to increase efficiency in the same manner as the cross-over valve between multiple vessels.

Furthermore, with programmable or selectable controls the same device can be used in any of these operating modes, or combinations of operating modes. This can include suction or discharge priority, as well as with and without the cross-over feature(s), and in level sensor or timer modes. Also, priority can be given to maximizing transfer rate or maximizing energy efficiency when setting up these or other modes.

Versions of the device can also be setup without the option of programmable or selectable modes and features when the application or operating conditions don't warrant the added cost, complexity or operator interaction.

In the event that the common suction pipe or hose 13 is blocked, fouled or plugged the de-fouling valve 37 (FIG. 1) can be opened (manually, automatically, or semi-automatically) to pressurize the common suction pipe or hose and push any material that is stuck in the common suction pipe or hose out the suction end 38. This process can be done in concert, or timed, with the closure of one or all of the pinch valves at the inlet of each vessel 15, 16, or independently. The process can also be used in short bursts, or sustained over longer periods of time.

Novel Features

Pinch valves allow for large solids to pass easily, without fouling or clogging, as the opening when they are open is nearly the same shape and size as the piping in the general vicinity. Additionally, when the pinch valve is operated it does not expose any moving components or small openings that can foul, wear, or be damaged.

The devices have no mechanical components, small passages, or tight turns in the fluid path to foul or clog (i.e. no pumps, augers, valves, actuators, scrapers, etc.). Any mechanical components, such as valves, vacuum and/or pressure sources are isolated from the process flow. The material being transferred enters each vessel through a length of hose and/or pipe, a wye, a small number of fittings and a pinch valve. The material being transferred exits each vessel through a pinch valve, a Y, a length of hose and/or pipe, and a small number of fittings. All of the pinch valves, Ys, hose, pipe, and fittings have large passages and gradual sweeps, with no exposed moving, reciprocating or rotating parts or restrictions. This allows large and fibrous solids to pass easily through the system, without fouling or clogging.

Light, compact and mobile for use where traditional technologies cannot reach. The device lends itself to being sized based on the application, however the unit can be built small enough that it could fit down paths as narrow as 24 to 30 inches wide. The device could be made comparable in weight to a fully loaded wheelbarrow (300-600 pounds), so it can be moved by a single person.

Because the device is light, compact and mobile it can be placed close to the source vessel, keeping the common suction pipe or hose relatively short for maximum vacuum performance. Because positive pressure greater than one atmosphere (often many times greater) is used for discharging, the length of the discharge pipe or hose can be much longer, allowing the system to transfer material over substantial distances.

Discharging continuously or nearly continuously (for multi-vessel design) prevents increasing viscosity or solids settling in the discharge pipe or hose when the flow stops. Operating with continuous or nearly continuous suction increases efficiency by preventing material in the common suction pipe or hose from draining back into the suction vessel.

The invention can be used with pressurized fluid jets, such as but not limited to pressure washers, rotating high pressure wash nozzles, hydrolasers, orbital wash heads, or other methods to loosen the material to be drawn into the common suction pipe or hose.

One, two, or more vessels can be used to tailor the system to the application.

A programmable (such as, but not limited to, a programmable logic controller, programmable process controller or computer system), electrical (such as, but not limited to, electromechanical relays), pneumatic (such as, but not limited to, pneumatic logic controls), hydraulic (such as, but not limited to, hydraulic logic controls) or mechanical (such as, but not limited to, timing cams and linkages) control system can be used for automatic or semi-automatic operation. Making adjustments to the control program, timing, and/or control settings adjusts the operation, efficiency, throughput, and power consumption of the system.

Alternatively, an optional configuration specific control system can be used to reduce system cost and complexity or to reduce operator interaction when the application or conditions doesn't warrant the added flexibility.

The timing or sequence of each function (open and close timing of each valve) can be adjusted and/or optimized to the specific application or operating conditions. Valve timing can improve operational efficiency by using as much stored pressure/vacuum as possible or prioritize suction to reduce drainage back into the suction vessel during vessel switchover, or prioritize continuous discharge to prevent settling or increases in viscosity in the discharge pipe or hose. For instance, adjusting the opening and closing of pressure or vacuum valves and/or inlet and outlet pinch valves can increase or decrease the volumetric efficiency of the system, with a corresponding decrease or increase in consumption of compressed air and/or vacuum. Optimizing this timing to provide the best overall efficiency can reduce operating power consumption and operating costs.

Because any energy stored in the evacuated and/or pressurized vessels at the end of each half cycle is generally wasted, reducing the pressure and/or vacuum in each vessel at the end of each half cycle will reduce operating power consumption.

Alternatively, the control can be set to maximize transfer rate while sacrificing energy efficiency by choosing not to maximize the use of stored pressure or vacuum.

Optional vessel cross-over valves can equalize the pressure in adjacent tanks between each half cycle, allowing some of the energy stored in the pressure and/or vacuum at the end of each half cycle to be used to partially pressurize or evacuate the adjacent vessel, in order to further reduce the operating power consumption.

Optional pinch valve cross-over valves can equalize the pressure in adjacent pinch valves between each half cycle, allowing some of the energy stored in the pressure and/or vacuum within the pinch valves to be used to partially pressurize or evacuate the adjacent pinch valve, reducing operating power, in a similar manner to the vessel cross-over valve.

Optionally the device can include two or more integrated vessels arranged side by side in a single structure with a twisted/helical divider between each vessel, or concentric vessels with one encircled by the other one, or a second vessel on top of the first for more compact, mobile construction.

A tangential inlet causes centrifugal action, allowing the air flow to be separated from the liquid/solid constituents in a much smaller vessel than would be required without the centrifugal action. Material entering into the vessel on the tangential path follows a helical, cyclonic path along the walls of the vessel. Due to centrifugal action the heavier solid and/or liquid particles are thrown to the outside, while the less dense air and/or gas component is drawn into the vacuum outlet towards the center of the vessel. This separation allows the solids and liquids to be separated from the flow of air/gas into the vacuum system.

Similar separation can be obtained, without utilizing cyclonic action, in vessels that are much larger. Depending on the diameter of the cyclonic vessel and the flow rate into the vessel, vessels relying on large volumes for air/gas separation from liquids and solids might need to be three to ten times the volume of the cyclonic vessel to obtain similar separation.

The device can utilize a specific, or a variety of vacuum sources (independent, integrated, educator, etc.), depending on site conditions, available power and/or services, and the location of the source and discharge vessels.

The device can utilize a specific, or a variety of pressure sources (independent, integrated, etc.), depending on site conditions, available power and/or services, and the location of the source and discharge vessels.

This flexibility in vacuum or pressure sources allows the device to be tailored to the application, and the available utilities. If a vacuum and/or pressure source is available then the device can be smaller and more easily transported, however if those are not available then the option is available to add those to the system.

De-fouling can be performed by pressurizing the common suction pipe or hose with pressurized fluid/compressed air. This pressure can push any material plugging or fouling the common suction pipe or hose out of the suction end in order to keep the common suction pipe or hose flowing freely.

Included controls can be selectable between several operating modes and features, or fixed with a single specific mode or feature set based on the anticipated application, field conditions and desired level of operator interaction. The control options can include level sensing or timer, suction priority, discharge priority, cross-over, or maximum transfer rate mode.

In level sensing mode the suction and discharge controls are actuated based on sensor inputs indicating the level of material in each vessel. This provides more efficient operation when the material being transferred is known to accurately indicate the level with the sensors being used.

In timer mode the suction and discharge controls are actuated based on the expiration of timers. These timers may be adjustable or fixed, but they generally will be configured to ensure the unit does not overflow under the most or all conditions, resulting in less efficient material transfer.

In suction priority mode the suction and discharge controls are actuated in a sequence that creates a continuous or nearly continuous suction flow, while sacrificing continuity in the discharge flow. This continuous or nearly continuous suction flow provides more efficient removal of material from the source vessel, while the discharge flow may include periods of slowing or stopping that could result in increases in viscosity or solids settling in the discharge line, or potentially hazardous release of compressed air or gas into the discharge line. Suction priority mode would generally be used when the material being transferred alleviates these concerns (for example with a liquid with viscosity that is not sensitive to shear affects and has little to no settling solids) and/or when higher material removal efficiency is required or desired.

In discharge priority mode the suction and discharge controls are actuated in a sequence that creates a continuous or nearly continuous discharge flow, while sacrificing continuity in the suction flow. This continuous or nearly continuous discharge flow prevents periods of slowing or stopping in the discharge flow that could cause increases in viscosity or solids settling in the discharge line, and also prevents potentially hazardous release of compressed air or gas into the discharge line. Discharge priority mode sacrifices efficient removal of material from the source vessel. During periods of slowing or stopping in the suction flow material in the suction conduit may flow back into the suction vessel and need to be retrieved a second time.

Discharge priority mode would generally be used when the material being transferred exhibits viscosity that is sensitive to shear affects and/or has potentially settling solids and/or when higher material removal efficiency is less important.

In maximum transfer rate mode the suction and discharge controls are actuated in a sequence that operates the device at the maximum achievable transfer rate, regardless of the suction, discharge, or energy inefficiency.

Cross-over mode uses the vacuum or pressure trapped in one vessel at the end of a cycle to pre-charge or pre-evacuate one or more of the other vessels by momentarily opening the cross-over valve between the vessels so that the pressures can equalize between them. This conserves some of the stored energy (pressure or vacuum) in the system at the end of the cycle for use during the next cycle. Cross-over mode is used when energy efficiency is the priority.

Utilizing level monitoring the control can prevent compressed air from being regularly discharged, eliminating/mitigating the hazard of having compressed air regularly stored in the discharge pipe or hose. By monitoring the level of material in the discharging vessel, the discharge pinch valve can be shutoff before the vessel is discharged completely and pressurized fluid/compressed air is pushed out the discharge. Having pressurized gasses (i.e. air) regularly stored in the discharge pipe or hose poses a hazard because the compressibility of air allows large quantities of energy to be released quickly if a discharge pipe or hose fails. When a liquid, or slurry is pumped at the same pressure, hose failures only result in leaks, not catastrophic energy releases.

An optional bladder can separate pressurized fluid/compressed air from material being pumped within each vessel.

A working prototype example of the device was created by AGI Manufacturing, Inc. and AGI Engineering, Inc. in Stockton, Calif., in February of 2016. The device includes two aluminum vessels, with an option to add a third vessel and is operated by an external vacuum source and external air compressor. The device operates on the same process schematic outlined in FIG. 1.

Each vessel is approximately 16 inches in diameter and 48 inches long, with cone bottoms and domed lids that can be detached to service or clean the tanks. The vessels sit on folding, retractable, adjustable support legs at approximately a 45 degree angle to the ground to lower the center of gravity during operation.

The device can be partially disassembled, if necessary, in order to save weight for transportation, and wheelbarrow style wheels and a pair of handles can be used to transport the device.

Each vessel includes tangential inlets, vacuum outlets with pneumatically operated vacuum valves, pressurized fluid/compressed air inlets, pressure relief valves, pressure transducers and optional high-high level float switches mounted in the domed lid (to help prevent overfilling). Low, medium and high level switches are mounted at specific fluid levels in the body of each vessel. Pressurized fluid is controlled by one direct acting solenoid valve for each vessel.

The prototype device was also tested with capacitive, float, and tuning fork level switches to proof and compare operation with each. Additionally, switch locations were varied to simulate smaller or larger vessel sizes.

The device also includes a pneumatically operated cross-over valve and pneumatically operated 4 inch inlet and outlet pinch valves. The defouling valve is a direct operated solenoid valve.

The pneumatically operated pinch valves, vacuum valves and cross-over valves are controlled by solenoid spool valves. These valves operate on an independent air system that includes air filtration and regulation to maintain air cleanliness as well as adjust the valve operating pressure independently (between approximately 80 to approximately 110 PSI) from the process compressed air.

The process compressed air includes a separate high flow air regulator to adjust the pressure independently (between approximately 40 and approximately 100 PSI) depending on the requirements of the material being transferred.

The common suction hose or pipe includes a rigid portion of 4 inch schedule 10 aluminum pipe approximately 5-6 feet long, with handles for ease of operation, and approximately 25 feet of an approximately 4 inch suction hose for extracting material from the source vessel. The handles include a start/stop button for initiating suction, as well as for controlling the defouling valve. A suction classifier fitting with an opening smaller than the smallest passage in the process flow is fitted on the suction end of the common suction pipe or hose so that any objects that pass through the classifier fitting can pass through the entire system.

The device was tested transferring material to the discharge vessel through an approximately four inch discharge hose ranging from approximately 50 to approximately 100 feet in length. The transfer rate for approximately 45% kaolin clay slurry in water is approximately 30 to approximately 50 gallons per minute. The maximum transfer rate with raw water was approximately 200 to approximately 300 gallons per minute.

The device was tested with a programmable total machine management control system, as well as a simplified programable "smart relay" control system. The total machine management control system included a programmable control with discrete and analog inputs and outputs, as well as an operator interface with a screen and a multitude of buttons and knobs for making adjustments.

The "smart relay" control system simplified the operator interface to a single start/stop button and emergency stop button. This system demonstrated the device could operate with simpler, more easily serviced, more economical controls. The programming of the "smart relay" was similar to relay or pneumatic logic, demonstrating that either of those configurations can also be used successfully.

The term conduits can include hoses and/or pipes. The term fluid can include gas and air.

The term "approximately" can be +/−10% of the amount referenced. Additionally, preferred amounts and ranges can include the amounts and ranges referenced without the prefix of being approximately.

The control system was tested with each of the possible control strategies. This included suction and discharge priority, timer, float switch, and cross-over modes.

While the embodiments reference cross-over ports and cross-over valves, the invention can use equalization ports, equalization valves, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A transfer system for transferring materials between vessels, comprising:

a pressurized transfer device for transferring liquefied material from a source vessel in a discharge to a discharge vessel, wherein the transfer device has no mechanical components in a fluid path of the liquefied material to foul and clog, wherein the liquified material is transferred under vacuum via a length of a conduit of approximately 5 feet to approximately 35 feet from the source vessel to the discharge vessel, and wherein the liquified material is transferred under positive pressure via a length of a conduit of approximately 50 feet to approximately 1,000 feet from the pressurized transfer device to the discharge vessel, and wherein the pressurized transfer device is sufficiently small and transportable so as to be positioned adjacent the source vessel.

2. The system of claim 1, wherein the liquefied material is a liquid.

3. The system of claim 1, wherein the liquefied material is a mixture of a liquid and solids.

4. The system of claim 1, wherein the liquefied material is a slurry.

5. The system of claim 1, wherein the discharge vessel stores the transferred liquefied material.

6. The system of claim 1, wherein the discharge vessel transports the transferred liquefied material to another location.

7. The system of claim 1, wherein the pressurized transfer device includes:

pinch valves for allowing solids to pass easily, without fouling and clogging hose connections between the source vessel and the discharge vessel.

8. The system of claim 1, wherein the pressurized transfer device includes:

a pressure source; and a vacuum, wherein vacuum causes liquefied material to pass in a first conduit from a source vessel into a vessel and positive pressure from the pressure source causes the liquefied material to pass in a second conduit between the vessel and the discharge vessel.

9. The system of claim 1, wherein the pressurized transfer device includes:

a programmable control for automatically controlling the transfer of the liquefied material between the source vessel and the discharge vessel, the control being selected from at least one of an electrical, pneumatic, hydraulic and mechanical control.

10. The system of claim 1, wherein the pressurized transfer device includes:

a preset control with limited adjustability for automatically controlling the transfer of the liquefied material between the source vessel and the discharge vessel, the control being selected from at least one of an electrical, pneumatic, hydraulic and mechanical control.

11. The system of claim 1, wherein the pressurized transfer device includes:

a control mode to operate a transfer cycle based on feedback from sensors, the sensors being selected from at least one of a level sensor, a pressure sensor, or a vacuum sensor.

12. The system of claim 1, wherein the pressurized transfer device includes:

a control mode to operate the transfer cycle based on the elapsing of timers.

13. The system of claim 1, wherein the pressurized transfer device includes:

a control mode to prioritize maintaining a continuous suction.

14. The system of claim 1, wherein the pressurized transfer device includes:

a control mode to prioritize maintaining a continuous discharge.

15. The system of claim 1, wherein the pressurized transfer device includes:

a control mode maximizing use of a residual pressure and a vacuum to conserve energy.

16. The system of claim 1, wherein the pressurized transfer device includes:

a control mode maximizing the overall transfer rate between the source vessel and the discharge vessel.

17. The system of claim 1, wherein the pressurized transfer device includes:

controls to start and stop the device from a location adjacent one of the device, the source vessel, and the discharge vessel.

18. The system of claim 1, wherein the pressurized transfer device includes:

a timer control for transferring material that level sensors have difficulty sensing.

19. The system of claim 1, wherein the pressurized transfer device includes:

cross-over valves.

20. The system of claim 1, wherein the pressurized transfer device includes:

pinch valve cross-over valves.

21. The system of claim 1, wherein the pressurized transfer device includes:

multiple vessels sharing a single outer cylindrical vessel wall.

22. The system of claim 1, wherein the pressurized transfer device includes:

multiple vessels nested inside of other vessels.

23. The system of claim 1, wherein the pressurized transfer device includes:

vacuum sources, selected from at least one of: independent vacuum sources and integrated vacuum sources.

24. The system of claim 1, wherein the pressurized transfer device includes:

pressure sources, selected from at least one of: independent pressure sources and integrated pressure sources.

25. The system of claim 1, wherein the pressurized transfer device includes:

defouling valves to eliminate blockages and fouling in at least one line between the source vessel and the discharge vessel.

26. The system of claim 1, wherein the pressurized transfer device includes:

level monitoring sensors to prevent compressed air from being regularly discharged, which eliminates and mitigates hazards of having compressed air be regularly stored in discharge conduits.

27. The system of claim 1, wherein the pressurized transfer device includes:

a bladder for separating pressurized air from the liquefied material being pumped into the pressurized transfer device.

28. A transfer system for transferring materials between vessels, comprising:

a pressurized transfer device for transferring liquefied material from a source vessel in a discharge to a discharge vessel, wherein the transfer device has no mechanical components in a fluid path of the liquefied material to foul and clog, wherein the pressurized transfer device includes:

a pressurized jet to loosen the liquefied material in the source vessel before transferring to the discharge vessel.

29. A transfer system for transferring materials between vessels, comprising:

a pressurized transfer device for transferring liquefied material from a source vessel in a discharge to a discharge vessel, wherein the transfer device has no mechanical components in a fluid path of the liquefied material to foul and clog, wherein the pressurized transfer device includes:

a twisted helical divider.

30. A transfer system for transferring materials between vessels, comprising:

a pressurized transfer device for transferring liquefied material from a source vessel in a discharge to a discharge vessel, wherein the transfer device has no mechanical components in a fluid path of the liquefied material to foul and clog, wherein the pressurized transfer device includes:

tangential inlet to cause centrifugal action to allow fluid flow to be separated from liquid/solid constituents, the fluid flow being selected from one of air flow and gas flow.

31. A transfer system for transferring materials between vessels, comprising:

a pressurized transfer device for transferring liquefied material from a source vessel in a discharge to a discharge vessel, wherein the transfer device has no mechanical components in a fluid path of the liquefied material to foul and clog, wherein the pressurized transfer device includes:

a suction classifier fitting with an opening smaller than a smallest passage in a process flow so that any objects that pass through the classifier fitting will pass through the entire system.

* * * * *